United States Patent [19]

Marentic

[11] 4,415,892

[45] Nov. 15, 1983

[54] ADVANCED WAVEFORM TECHNIQUES FOR PLASMA DISPLAY PANELS

[75] Inventor: Michael J. Marentic, Orange, Calif.

[73] Assignee: Interstate Electronics Corporation, Anaheim, Calif.

[21] Appl. No.: 273,094

[22] Filed: Jun. 12, 1981

[51] Int. Cl.[3] ..... G09G 3/28

[52] U.S. Cl. ..... 340/767; 315/169.4; 340/713; 340/776; 340/805

[58] Field of Search ..... 340/767, 771, 776, 779, 340/713, 805; 315/169.4

[56] References Cited

U.S. PATENT DOCUMENTS

| | | | |
|---|---|---|---|
| 3,786,474 | 1/1974 | Miller | 340/805 X |
| 3,786,484 | 1/1974 | Miavecz | 340/779 X |
| 3,843,905 | 10/1974 | Leuck et al. | 340/776 X |
| 3,863,023 | 1/1975 | Schmersal et al. | 315/169.4 X |
| 3,894,263 | 7/1975 | Wojcik | 340/713 X |
| 4,097,780 | 6/1978 | Ngo | 340/771 |
| 4,123,751 | 10/1978 | Gladstone et al. | 340/767 X |
| 4,140,945 | 2/1979 | Trogdon | 340/776 |

*Primary Examiner*—David L. Trafton

*Attorney, Agent, or Firm*—Knobbe, Martens, Olson & Bear

[57] ABSTRACT

A brightness control using modular waveform techniques is disclosed which enables a wide range of brightness control not affected by the order in which functions are executed. 512 cell parallel addressing is used, enabling the border electrodes to be discharged only once during each extended cycle, thus lowering the intensity of light emitted from the borders by at least a factor of 5. An erase before write technique is described which allows an erase operation to be inserted into a write function without extending the length of the write function, thus doubling the maximum data rate of the plasma panel display system.

28 Claims, 15 Drawing Figures

ADVANCED WAVEFORM TECHNIQUES FOR PLASMA DISPLAY PANELS

BACKGROUND OF THE INVENTION

Plasma display panels are presently in commercial use as digitally addressable information display devices. The panel itself typically consists of two glass plates with a gas mixture sealed between them. A plurality of X-axis electrodes extend in a mutually parallel array on an interior substrate of one plate, and a plurality of Y-axis electrodes extend in a mutually parallel array on the interior of the other plate. The X-axis electrodes are at a 90° angle to the Y-axis electrodes, thereby forming a plurality of intersections between the X-axis and Y-axis electrodes. A typical commercially available AC plasma panel has 512 X-axis electrodes and 512 Y-axis electrodes, yielding 262,144 intersections, or cells.

When a voltage of between 180 to 200 volts is applied across an X-axis electrode and a Y-axis electrode, a discharge in the gas occurs at the cell formed by the electrodes, causing a pluse of light to be emitted at this point. Simultaneously, a charge is collected on the cell wall, which results in the cell being an "on" cell. Once such a discharge has been produced and the cell is turned "on", the collected wall charge acts to continue the discharging when a lesser AC sustain voltage is applied between the electrodes. In an "on" cell, the gas will discharge and the cell will emit a pulse of light at each transition of the applied AC sustain waveform. The sustain voltage, however, is insufficient to initiate a discharge at an X-Y intersection. This phenomonen is known as inherent memory, and was originally disclosed by Baker et al, U.S. Pat. No. 3,499,167, and by Bitzer et al, in U.S. Pat. No. 3,959,190. By precisely timing, shaping, and phasing multiple alternating voltage waveforms supplied to X and Y axes electrodes, the generation, sustaining and erasure of light emitting gas discharges at selected locations on the plasma display panel can be controlled.

Four functions are used to control the operation of an AC plasma panel: the write function, the erase function, the sustain function, and the bulk-erase function. The write function causes a selected cell on the panel to change from the "off", or non-light emitting state, to the "on" or light emitting state. The sustain function maintains the state of all cells on the panel, i.e. causes "on" cells to remain on, and "off" cells to remain off. The sustain function also causes the "on" cells to emit light. The erase function causes a selected cell to be changed from the "on" state to the "off" state. The bulk-erase function causes all "on" cells in the panel simultaneously to be changed to the "off" state.

Operation of the write, erase, sustain, and bulk-erase functions is generally controlled by four logic signals: the X-sustain signal XS, the Y-sustain signal YS, the X-address pulse XAP, and the Y-address pulse YAP. These signals, generally supplied by a waveform ROM (Read Only Memory), are digital pulse trains typically operating at a frequency of 50 kHz. The logic signals are supplied to the sustain and drive circuits, and cause the circuits to execute the four control functions on the panel. Since the typical operational frequency of the plasma display system is 50 kHz, the four control functions operate on a 20 microsecond period.

Currently, the best existing brightness control circuit for an AC plasma panel is that described in "Constant Data Rate Brightness Control For An AC Plasma Panel", by Joseph T. Suste, a copending Patent Application, Ser. No. 273,095, filed June 12, 1981, assigned to the assignee of the present invention, and that specification is hereby incorporated herein by reference. The method used in the Suste application uses a waveform ROM which stores two groups of control signals. The first group performs sustain, write, erase, and bulk-erase functions in a normal manner, emitting two pulses of light per 20 microseconds cycle. The second group of control signals performs the same functions, but with the emission of substantially no light. By mixing the functions from the two groups and varying the ratio of the two groups, a broad range of variable brightness in the operation of the plasma panel is achieved.

Although the Suste brightness control is a great improvement over the prior art, it has several problems. The greatest of these problems occurs when the system is alternately generating brightness control write and brightness control erase functions. During this operation, light will be generated at the rate of 1 pulse per cycle. Therefore, when write and erase functions are being alternately performed, the minimum brightness achievable by the system is 50% of maximum brightness.

This constraint presents a problem, particularly when it is desired to operate the system at the minimum brightness level, 12.5% of full brightness. Sustain pulses at this minimum intensity will provide the correct panel intensity, but if alternate write and erase operations are performed, there will be light flashes four times brighter than this minimum intensity.

A second problem inherent in the Suste brightness control system is that the maximum light the system is capable of producing occurs when the system emits two pulses of light for every 20 microsecond period. The use of plasma panels in areas having a high level of ambient light makes it desirable to increase the number of light emissions per unit of time, to obtain a somewhat higher level of maximum brightness.

It is also desirable to perform 512 cell parallel addressing, which would allow an entire line on a typical 512×512 plasma panel be addressed simultaneously. Such parallel addressing is desirable because it increases the data rate of the panel, that is, the maximum rate of writing and erasing the panel, by a factor of 5.3. Since the display characteristics of the plasma panel generally improve as the update rate is increased, particularly in cases where the panel is being used as a video display, a major objective in plasma display panel system design is to increase the update rate as much as possible.

Another problem in the design of brightness control systems for plasma panels is the high intensity discharge of the plasma panel borders. In order to perform write operations on a plasma panel, it is necessary that there be a sufficient number of free particles present in the gas mixture to initiate an avalanche process which causes a write operate to occur. The technique generally used to supply a sufficient quantity of free particles for a write operation utilizes border electrodes around the perimeter of the addressable display area of the plasma panel, which are driven by separate electronic circuits at a sufficiently high voltage level to cause very intense discharges to occur in the border areas. These discharges flood the viewing area of the plasma panel with a sufficient number of free particles to enable the panel to be written with a high degree of accuracy. In past systems, the intensity of light emitted by the border electrodes has not been controllable. In other words, while the viewing area of the panel may be driven so that the brightness level of the display is fairly low, the borders continue to operate at full intensity, and are highly visible to plasma panel observers. It is therefore desirable to reduce the intensity of light generated by these border electrodes.

SUMMARY OF THE INVENTION

The present invention utilizes a modular waveform generator technique disclosed in "Modular Waveform Generator for Plasma Display Panels", by Michael Marentic and Daniel Manseau, a copending Patent Application, Ser. No. 273,092, filed June 2, 1981, assigned to the assignee of the present invention, and that specification is hereby incorporated herein by reference.

The modular waveform generator uses two Read Only Memories (ROMs) which are cascaded. These ROMs include a module generator ROM, which operates at a fast access time, and a string generator ROM, which operates at a slower access time. The module generator ROM generates logic control signals which will generate small portions or modules, of the desired waveforms for operating the panel. These modules perform a single operation in the minimum required time. The modules are assembled by the string generator ROM into complete waveforms.

512 cell parallel addressing can be achieved by having the string generator ROM form a string comprised of sustain pulses for a period of time sufficient to enable the 512-cell addressing information to be loaded, and then by causing the write function to be executed. In the same way, an erase function for 512 cell parallel addressing can be generated. The modular waveform generator does not require complex external control logic, and the amount of memory utilized is minimized.

According to the present invention, using the modular waveform generator, the string of pulses which performs either a write or an erase operation can be assembled using blank sustain modules, so that the number of discharges causing the emission of light can be controlled. The use of strings that are 100 microseconds or longer enables alternating write and erase operations to be executed while operating the system at a low level of brightness. In this way, the problem of light flashes at 50intensity are eliminated by the present invention.

Also, according to this invention, only two modules are used to perform the sustain function and thus although a sustain operation can be carried out in 15 microseconds, it is generally executed in 16.67 microseconds (60 KHz). Since this permits the sustain operations to be performed at a higher frequency than in a system having a fixed 20 microsecond period, the maximum brightness of the system of the present invention is greater than the maximum brightness of a 20 microsecond time base system. Since the present system is capable of maximum intensity approximately 20% higher than previous systems, the overall range of brightness control is greater.

The present invention is also capable of a new type of operation—an erase before write operation. In an erase before write operation, an entire line is erased and then re-written in one cycle. This technique is made possible by the fact that, with 512 cell parallel addressing, a cycle is 100 microsecond or longer. The erase before write function enables a system that is continuously updating the information display, such as a video display terminal, to further double its update rate. Therefore, the system of the present invention increases the update rate of the plasma panel display by a factor of 10.6, while enabling the brightness of the display to be precisely controlled over a greater overall range of brightness.

RELATED APPLICATIONS

This specification is one of a group of specifications on plasma display technology, all assigned to the present assignee, including: System For Driving AC Plasma Display Panel, Ser. No. 166,579, Filed July 7, 1980, by Joseph T. Suste; MOSFET Sustainer Circuit For An AC Plasma Display Panel, Ser. No. 258,757, Filed Apr. 29, 1981, by Larry F. Weber; Constant Data Rate Brightness Control For An AC Plasma Panel, Ser. No. 273,095, filed June 12, 1981, by Joseph T. Suste; Distributed Conditioning For An AC Plasma Panel, Ser. No. 273,093, filed June 12, 1981, by Michael J. Marentic and Joseph T. Suste; Plasma Display Panel Drive Electronics Improvement, Ser. No. 272,885, filed June 12, 1981, by Michael J. Marentic; and Modular Waveform Generator For Plasma Display Panels, Ser. No. 273,092, filed June 12, 1981, by Michael J. Marentic and Daniel A. Mansean.

DETAILED DESCRIPTION OF THE DRAWINGS

Figure 12:
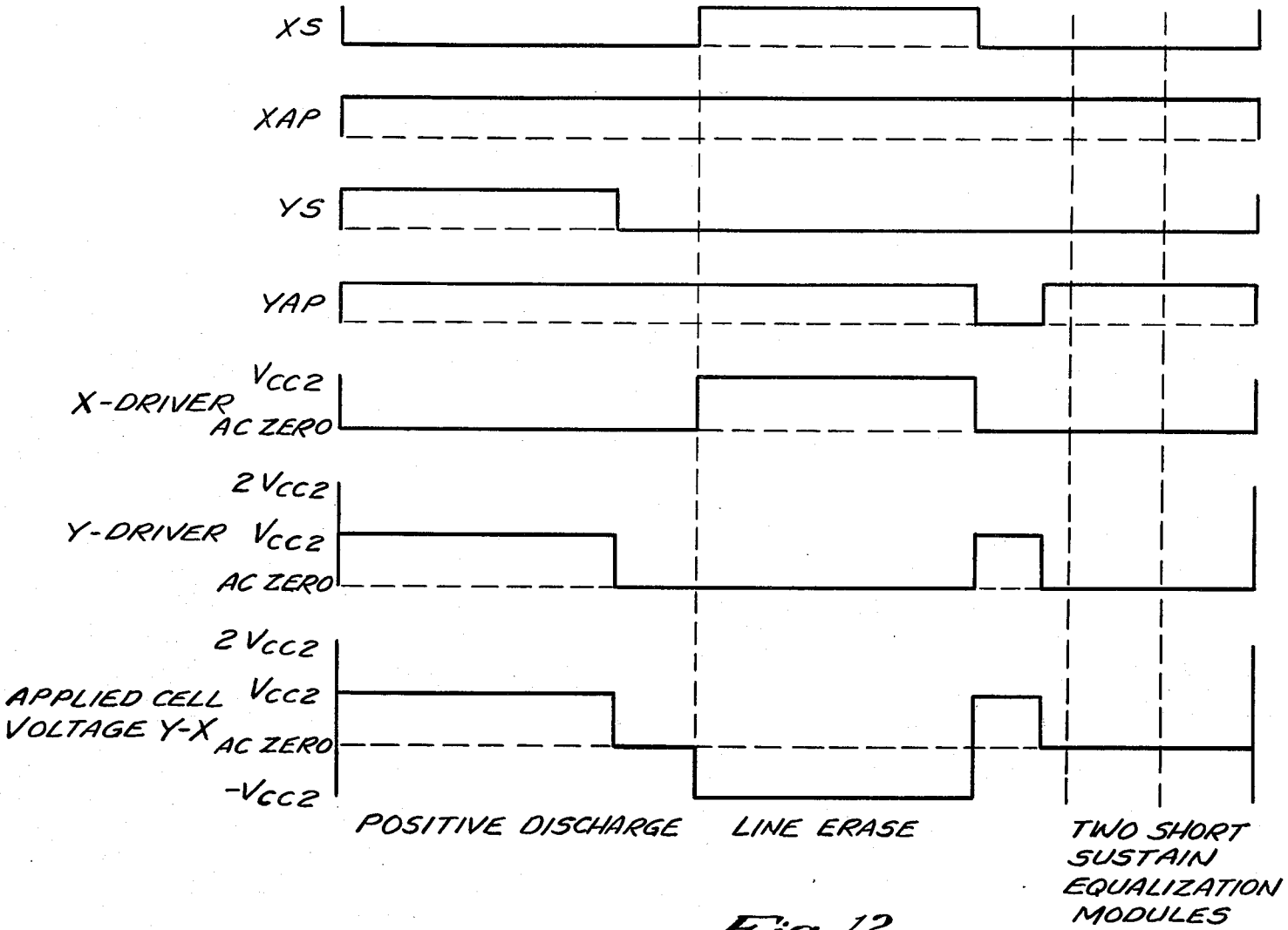
Figure 13:
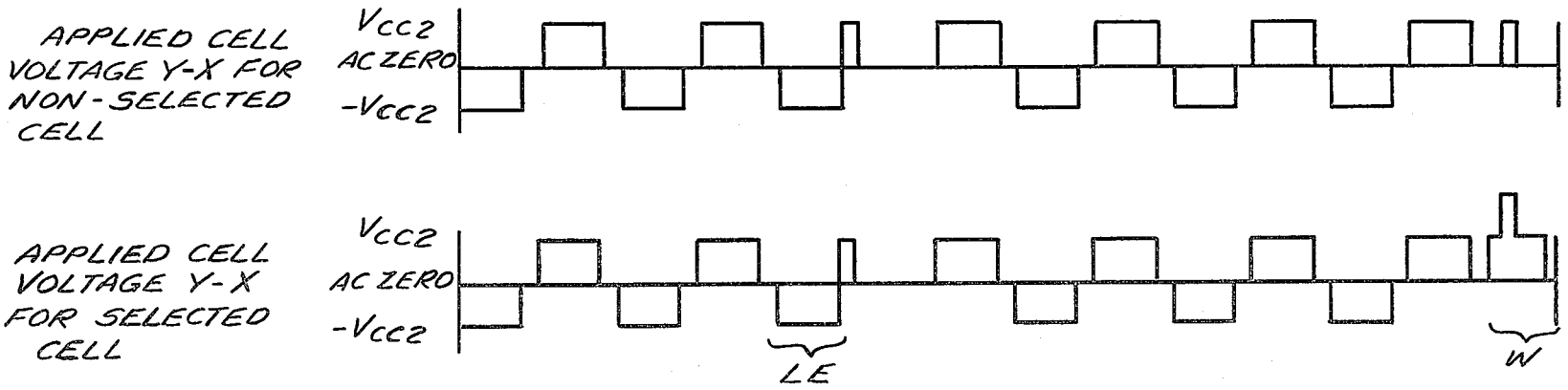

FIG. 12 shows the applied cell voltage Y–X, the Y-driver voltage, the X-driver voltage, and the logic signal outputs generated by the modular waveform generator for a line erase module, and the positive discharge module and short sustain equalization modules preceding and following the write-erase module; and FIG. 13 shows the applied cell voltage Y–X for a selected cell and for a non-selected cell, for a 512 cell parallel erase before write function.

DESCRIPTION OF THE PREFERRED EMBODIMENT

Figure 1:
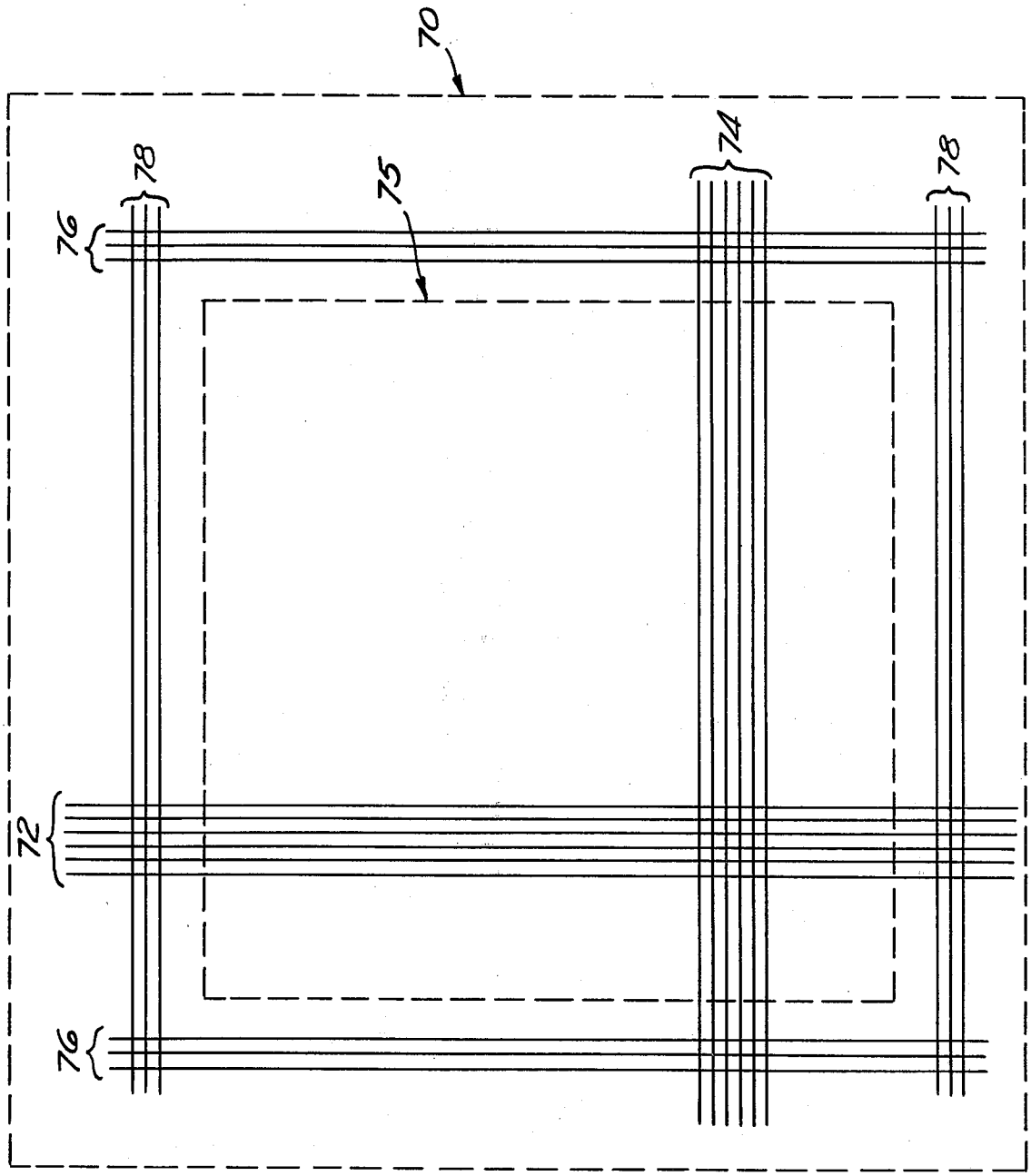
Fig. 1 PRIOR ART
FIG. 1 is a diagram of the electrode configuration of an AC plasma panel showing border sustainer electrodes and display area electrodes for a border sustainer type system.

FIG. 1 depicts a prior art plasma panel 70 and some of the electrodes contained in that panel. The X-electrodes 76, 72 are formed on an interior substrate of a first glass plate, while the Y-electrodes 78, 74 are formed on a second glass plate. These plates are spaced from one another, and a gas is sealed between them. The X-border electrodes 76 and the Y-border electrodes 78 are located around the perimeter of the plasma panel. The electrodes in the visual display area 75 of the plasma panel 70 are X-electrodes 72 and Y-electrodes 74. The electrodes 72, 74 depicted in FIG. 1 represent only a portion of the total number of electrodes, since there are 512 X-electrodes and 512 Y-electrodes in the visual display area 75.

Figure 2:
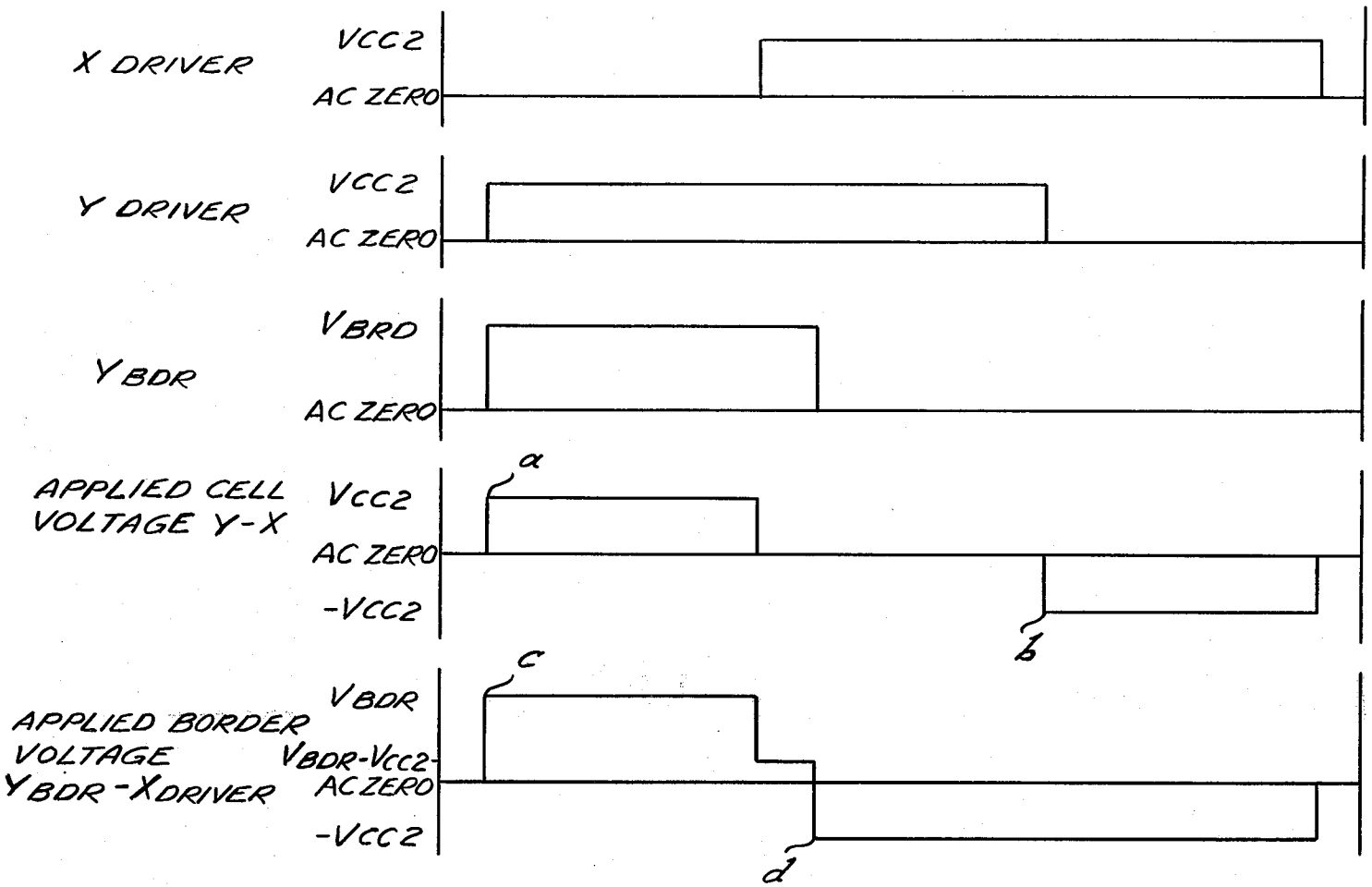
FIG. 2 is a waveform diagram showing the outputs of the drive circuitry, the Y-border sustainer output, the applied cell voltage Y—X and the applied border cell voltage $Y_{BDR}$—X, for a border sustainer-type system.

Free particles used to initiate the discharges in the visual display area 75 are generated by discharges at intersections between the X-electrodes 72 and Y-border electrodes 78, and the intersections between the Y-electrodes 74 and X-border electrodes 76. The voltage levels which are supplied to these electrodes during a sustain operation are shown in FIG. 2. The voltage supplied to the X-electrodes 72 is X-driver, the voltage supplied to the Y-electrodes 74 is Y-driver, the voltage supplied to the Y-border electrodes 78 is $Y_{BDR}$. The voltage levels supplied to the X-border electrodes 76 is not shown.

The voltage supplied to a single display area cell, or intersection between an X-electrode 72 and a Y-electrode 74 in the viewing area 75, is the applied cell voltage Y–X. The points in the applied cell voltage Y—X where light pulses will be emitted from "on" cells are indicated by a and b in FIG. 2.

The voltage applied to border cells, or intersections between the X-electrodes 72 and the Y-border electrodes 78, is the applied border voltage $Y_{BDR}$–X driver. The voltage applied to the Y-border electrodes 78, $V_{BDR}$, is of a greater magnitude than the voltage applied to Y-electrodes 74 in the viewing area 75. The magnitude of this voltage, $V_{BDR}$, is typically 120 to 150 volts, which is a voltage level high enough to ensure that discharges will occur in the border areas, supplying free particles at each discharge to the rest of the panel.

The applied border voltage, $Y_{BDR}$–X-driver, will therefore vary between $V_{BDR}$ and $-V_{CC2}$, a 220 to 250 volt swing. This large voltage swing will cause very intense discharges to occur in the border cells at the point indicated on the applied border voltage $Y_{BDR}$–X-driver waveform as C, and a second discharge will take place at d. These discharges generate the particles necessary to ensure that reliable write operations occur in the visual display area 75 of the plasma panel 70.

The X-electrodes 72 and the Y-electrodes 74 making up the visual display area 75 are driven by sustainer and driver circuits common in the art, as described above. These sustainer and driver circuits are controlled by the logic signals XS, YS, XAP, and YAP. These logic signals may be used to cause write, erase, sustain, and bulk-erase functions to be executed on the panel 70.

The Suste brightness control described in the specification incorporated by reference above entitled "Constant Data Rate Brightness Control For An AC Plasma Panel" discloses waveforms for executing the write, erase, and sustain functions while emitting substantially no light. These brightness control waveforms work well for most applications. However, if the operations to be done are alternate brightness control write and brightness control erase functions, as shown in FIG. 3, a problem is encountered.

Figure 3:
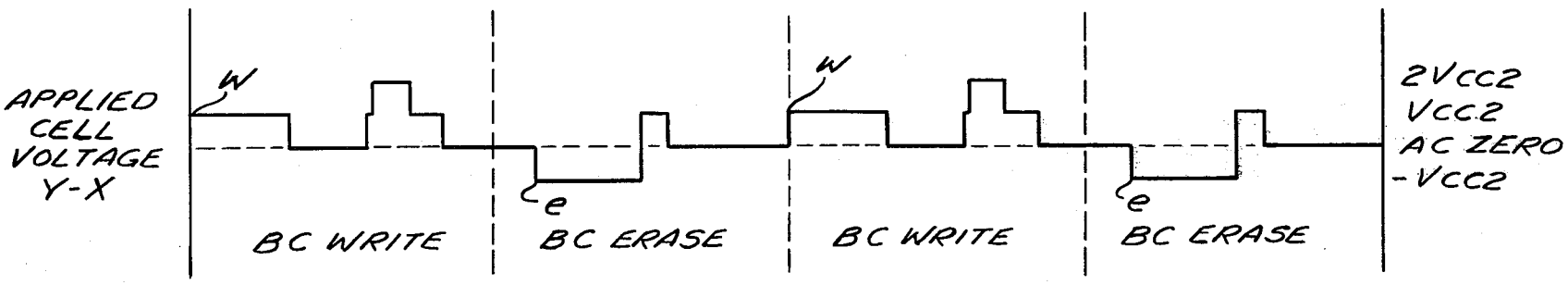
FIG. 3 shows alternate 20 microsecond brightness control write and erase functions, and the points at which light will be generated by such a waveform.

The series of functions in FIG. 3 should cause the emission of substantially no light from the plasma display panel, but in reality, light pulses will be emitted by the brightness control write function at the points indicated by w, and in the brightness control erase functions at the points indicated by e. Therefore, during the time that the alternate brightness control write and brightness control erase functions are being generated, the intensity of light emitted by the display will be 50% of maximum brightness, instead of the near zero brightness that should be the level of light emission during the time brightness control functions are being utilized.

In order to understand how the aforementioned problems are solved, it is necessary to understand how a modular waveform generator operates.

The present invention uses a modular waveform generation circuit which separates each of the waveforms used to address the plasma panel into modules. The modular waveform generator circuit is claimed in the above-identified copending application entitled "Modular Waveform Generator For Plasma Display Panels". By combining the modules in different sequences, any desired waveform may be generated. Each module begins and ends with no discharge activity taking place, and the applied cell voltage Y–X is at the AC zero voltage level at the beginning and end of each module. This requirement enables any module to follow any other module.

Figure 4:
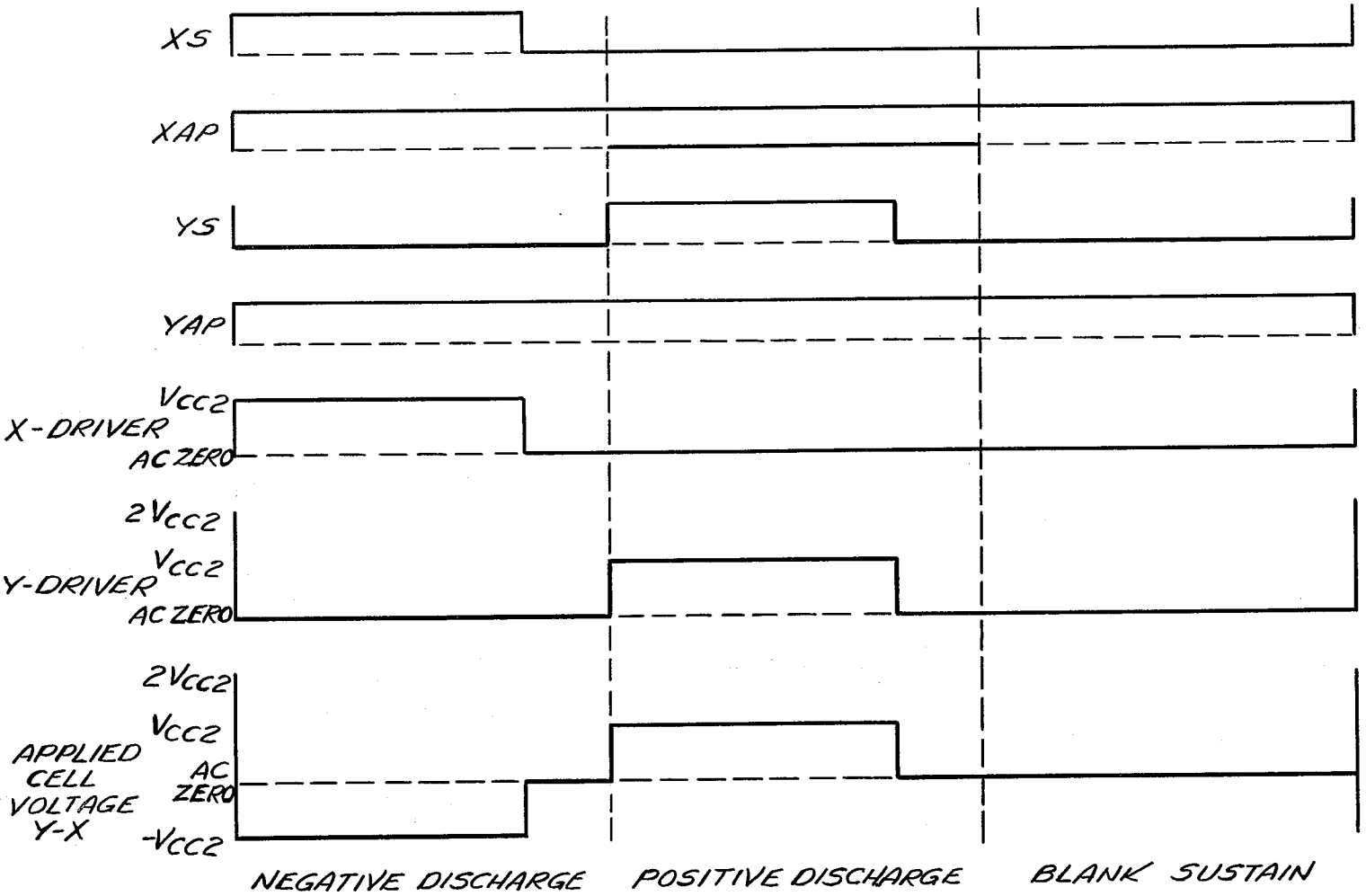
FIG. 4 shows the applied cell voltage Y—X, the Y-driver voltage, the X-driver voltage, and the logic signal outputs supplied by the present invention for a positive discharge module, a negative discharge module, and a blank sustain module.
Figure 5:
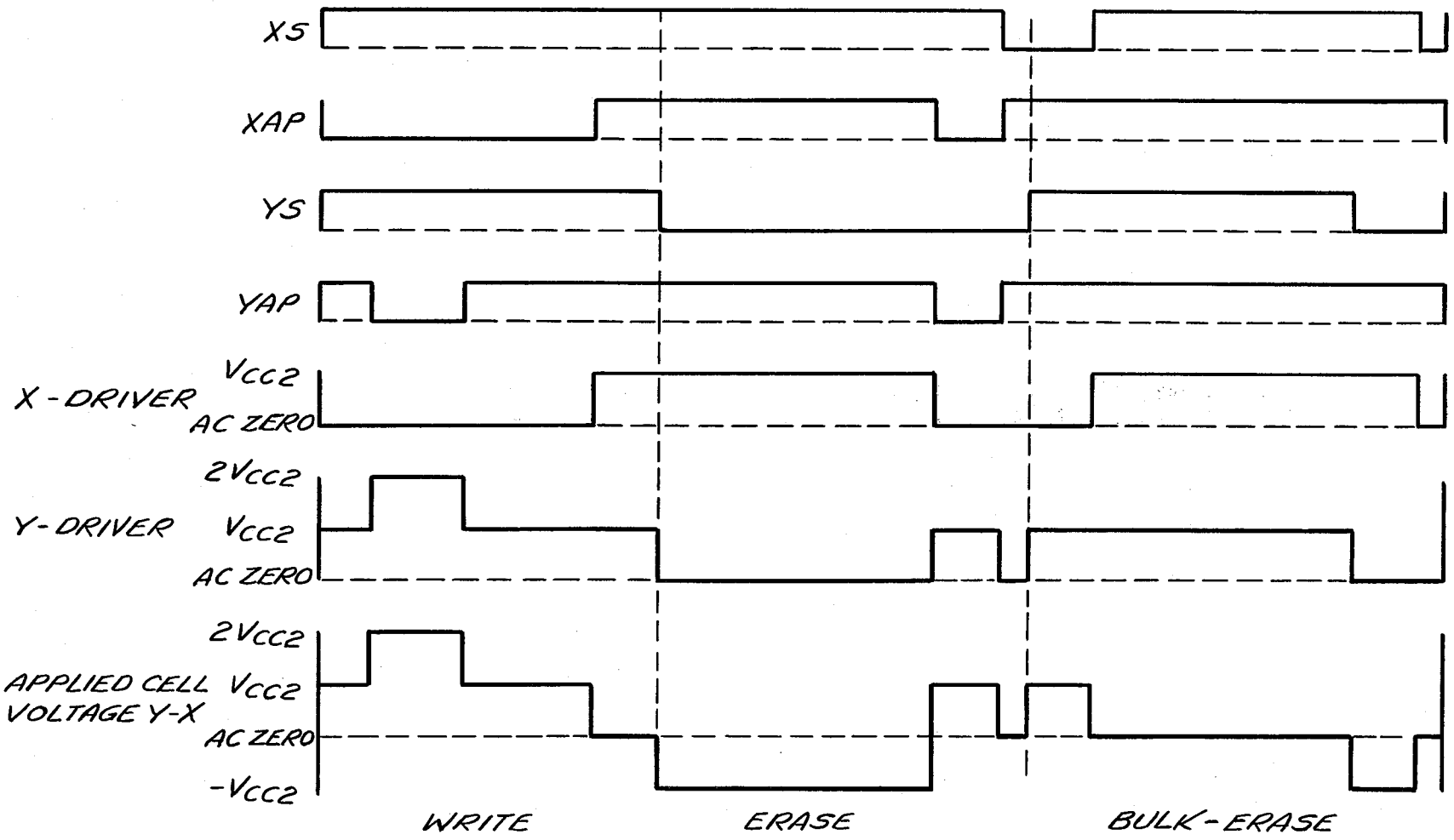
FIG. 5 shows the applied cell voltage Y-X, the Y-driver voltage, the X-driver voltage, and the logic signal outputs supplied by the present invention for a write module, an erase module, and a bulk-erase module.
Figure 6:
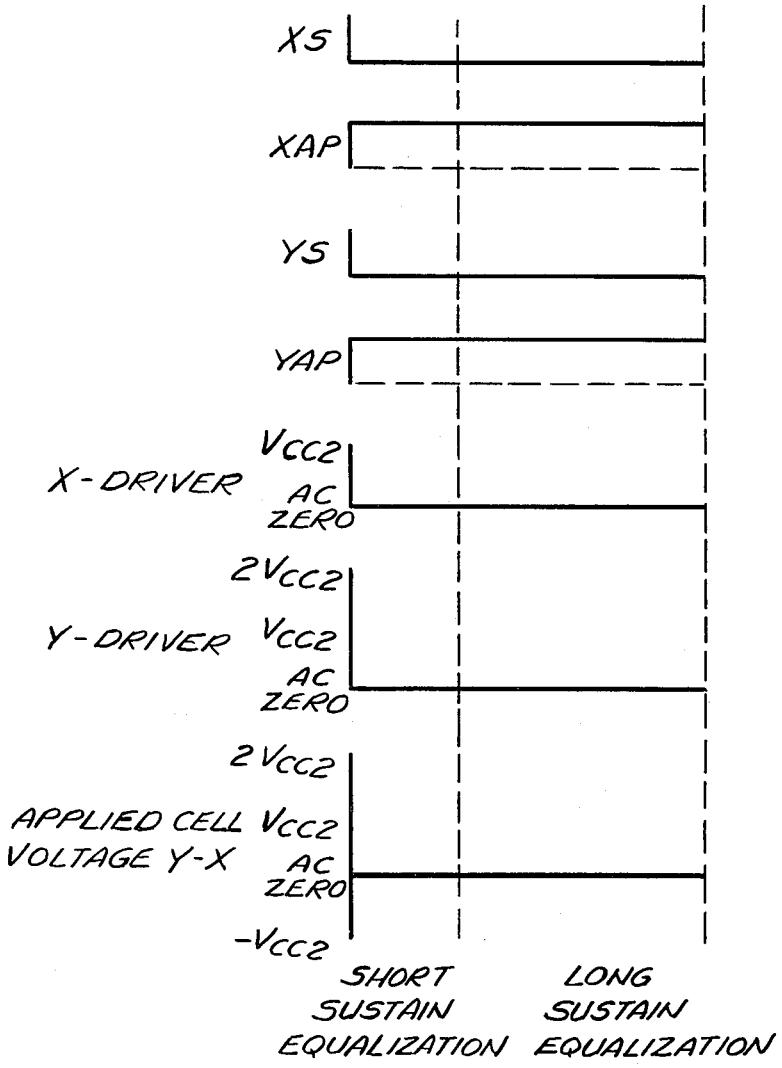
FIG. 6 shows the applied cell voltage Y-X, the Y-driver voltage, the X-driver voltage, and the logic signal outputs supplied by the present invention for a short sustain equalization module and a long sustain equalization module.

The modules used to generate waveforms to address the plasma panel are shown in FIGS. 4–6. The logic signals shown in these figures (XS, XAP, YS, and YAP) are supplied to the sustain and driver circuits (not shown), which, in response, generate the waveforms X-driver, Y-driver, shown in FIGS. 4–6. These waveforms cooperate to generate, at the plasma panel 70, the applied cell voltage Y–X, which performs the functions indicated.

The first module in FIG. 4 is a negative discharge module. The second module in FIG. 4 is a positive discharge module. The second module is a positive discharge module. A negative discharge module and a positive discharge module are the two components required to perform the sustain function. When a negative discharge module is followed by a positive discharge module, a single sustain cycle is generated. The negative discharge module and the positive discharge module are also used as components of other functions, when combined with other modules.

The third module shown in FIG. 4 is the blank sustain module, which is used for the brightness control claimed in the present application.

The first module in FIG. 5 is a write module. When the write module is preceded by a positive discharge module (FIG. 4), a complete write function will be performed. If a sustain function is preceded by the write function, the positive discharge module is not necessary, since a sustain function ends with a positive discharge module.

The second module in FIG. 5 is an erase module, and when followed by a positive discharge module, a complete erase function will be performed. The positive pulse of the positive discharge module is necessary, following the erase module, because each string of modules comprising a function must end with a module producing a positive pulse, so that the first pulse of a succeeding sustain function will produce a discharge of light. A positive pulse is produced by positive discharge and write modules.

The final module shown in FIG. 5 is the bulk-erase nodule. This module alone will perform the bulk-erase function. Since it is comprised of two very short pulses, which pulses erase the entire display, a succeeding sustain function will not produce a pulse of light in any case. Thus, it is not necessary to follow the bulk-erase module with a positive pulse producing module; therfore, the bulk-erase module is an exception to the requirement of ending a function with a positive pulse producing module.

The two modules shown in FIG. 6 are a short sustain equilization module and a long sustain equilization module. These two modules are characterized by an applied cell voltage Y–X at the AC zero voltage level, and are used for spacing purposes. These spaces are required when it is necessary to have a string of modules in a certain time period, and are most commonly used for brightness control systems which are capable of parallel addressing 512 cells, as is the case in the present invention.

Figure 8:
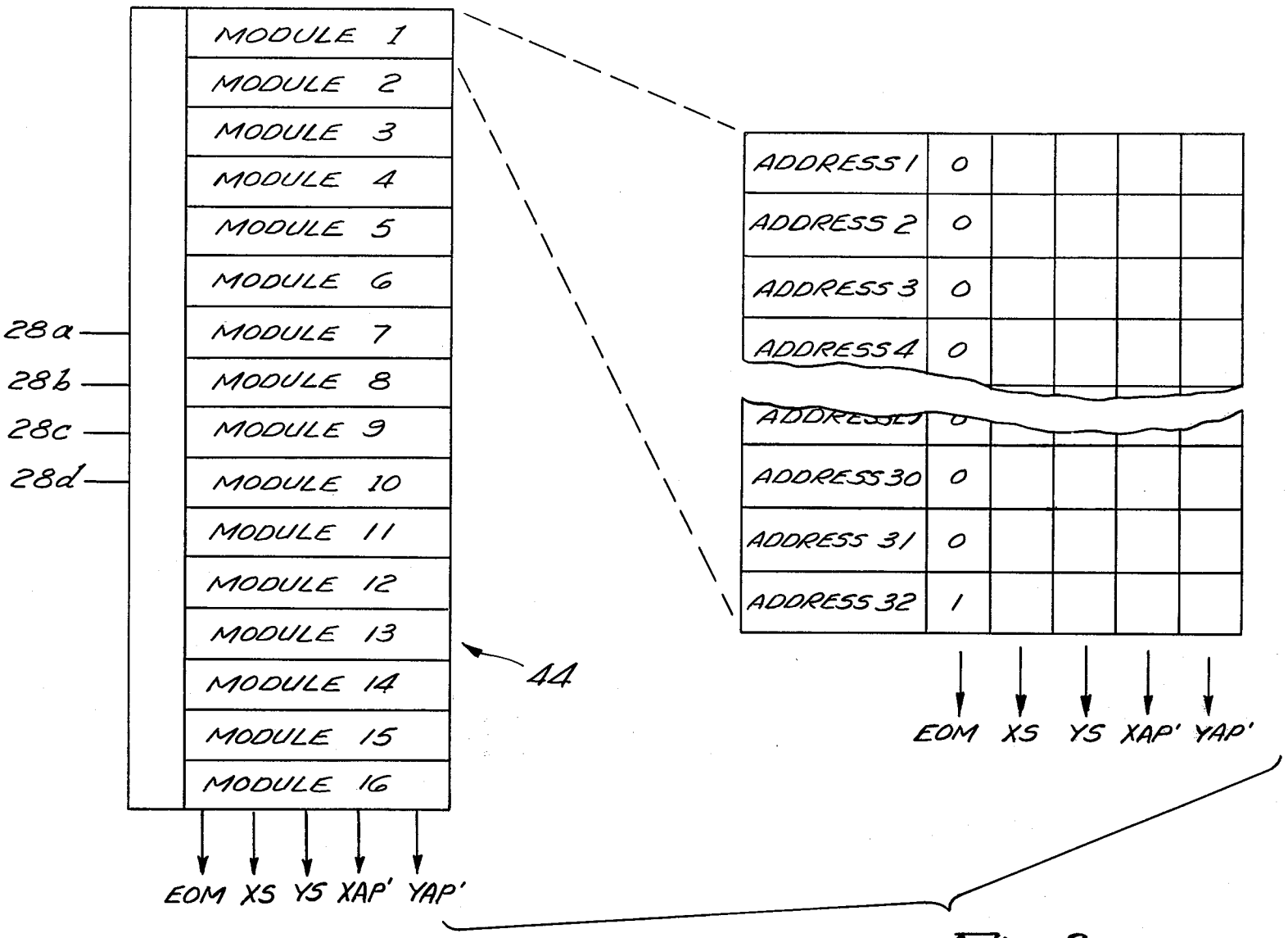
FIG. 8 is a schematic diagram of a digital memory device storing 16 modules, each module having 32 addressable locations, for generating logic signal outputs causing one of the basic module operations shown in FIGS. 4–6 to be executed on a plasma panel.

The system of the present invention has the capability of storing 16 different modules. When any one of these modules is accessed, the system must output the four logic signals (XS, YS, XAP', YAP') which will cause the waveform generated by that module to be executed on the plasma display panel. FIG. 8 shows, schematically, a module generator ROM 44 storing information to perform 16 different modules. Module 1 is shown to have 32 address locations, and the operation performed by module 1 will be executed by stepping through these locations, in order to produce binary bit patterns which define the logic signal outputs. An additional signal generated by each of the modules is the "end of module" signal EOM. This signal is necessary, since different modules require different time periods.

For example, in order to produce a short sustain equilization module, only 7 of these address locations are utilized. However, in order to perform the longer erase function, all 32 of the address locations are needed. Since each module will be performed in the minimum amount of time required, the end of module signal EOM is necessary to indicate that the module is completed. Therefore, the EOM bit for all but the last address location utilized will have a 0 logic level. For the last address location utilized, the EOM bit will be 1, indicating that the operation performed by the module is complete.

Figure 9:
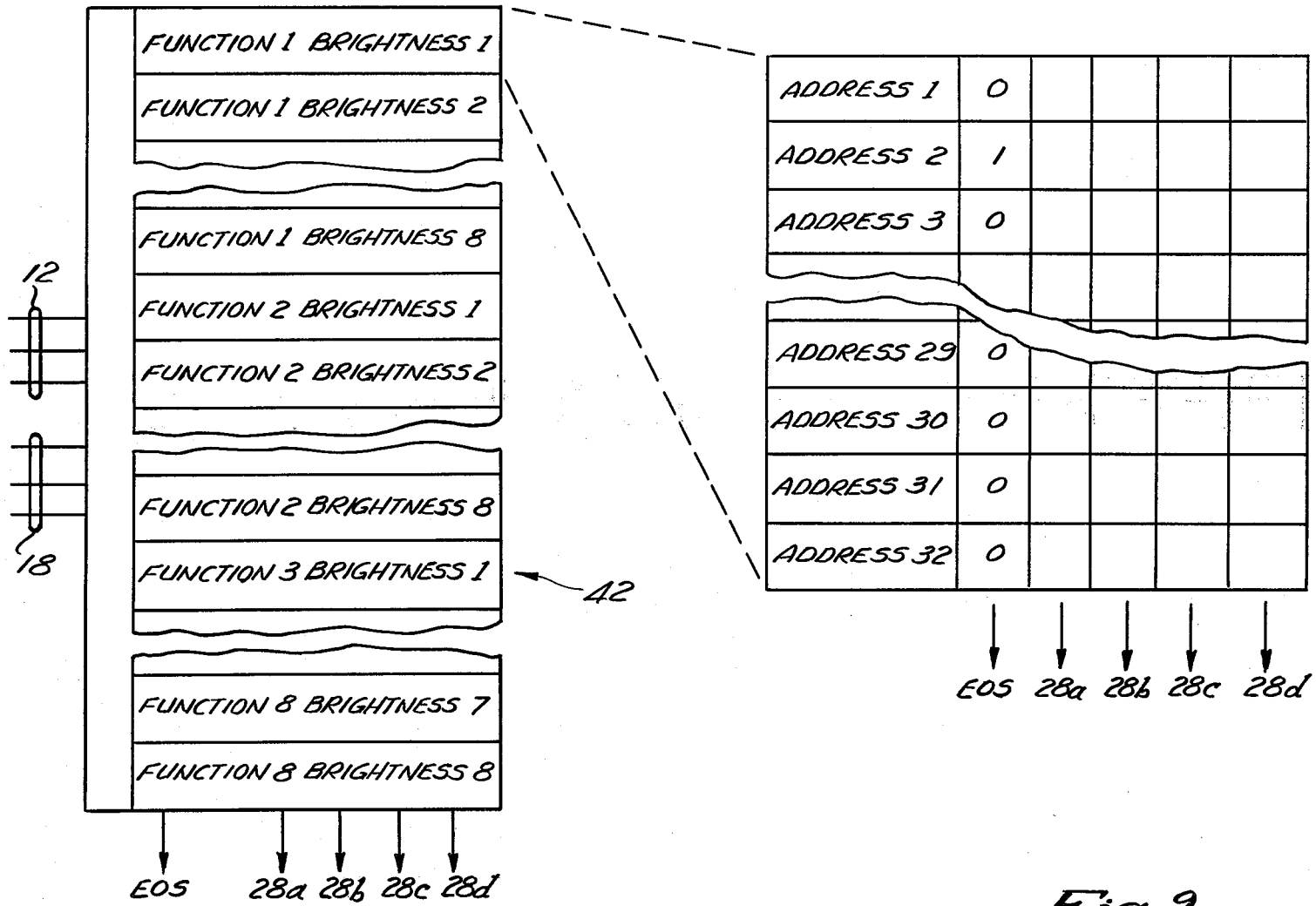
FIG. 9 is a schematic diagram of a digital memory device having 64 address groups, each group having 32 addressable locations, for causing a selected group of modules from the device in FIG. 8 to be sequentially accessed.

Since there are 16 different modules, four address bits 28*a*, 28*b*, 28*c*, and 28*d* are required to select one of the 16 modules. These address bits 28*a*, 28*b*, 28*c*, and 28*d* are provided by a string generator ROM 42, shown schematically in FIG. 9. The string generator ROM 42 sequentially addresses groves of modules from the module generator ROM 44 to assemble a string of modules into a complex waveform. The string generator ROM 42 is shown to provide 8 functions, each at 8 brightness levels, requiring a total of 64 address groups. Each of these address groups contains 32 address locations, each identifying a module. Thus, each string may include up to 32 modules. In other words, each of the addressable locations stores address bits 28*a*, 28*b*, 28*c*, and 28*d* which identify 1 module, and cause that module to be executed.

There is an additional logic signal output, the "end of string" signal EOS. When the EOS signal is at a logic level of 1, it indicates that the last module in the string is being generated. For example, if a sustain function is being generated, a negative discharge module and a positive discharge module must be produced. Since there are only two modules in the basic sustain function, addressable location 2 would have a 1 bit for the EOS logic signal.

Figure 7:
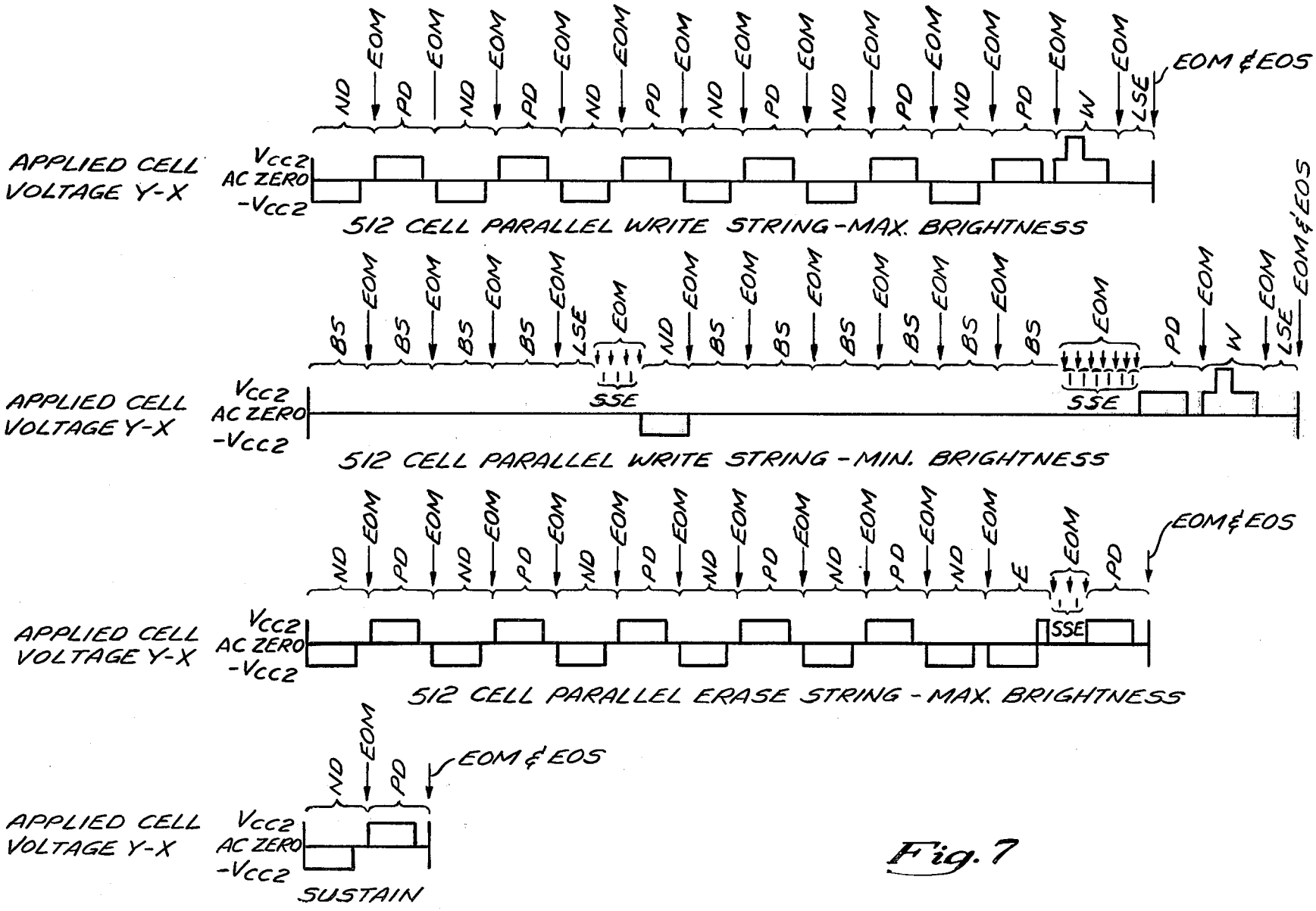
FIG. 7 shows the assembled string for 512 cell parallel addressing write and erase functions, for the sustain function, the assembled strings being composed of modules shown in FIGS. 4–6.

Referring now to FIG. 7, a number of examples will be utilized to describe the use of modules to assemble functional strings. For example, for a sustain function, a negative discharge module (ND) will be generated, and at the last point in that module, "end of module" signal EOM will be generated. As can be seen from FIG. 7, each module ends with an EOM signal, which causes the system to access the next module from the ROM 44. In the case of the sustain function being described, this next module is a positive discharge module (PD). When the positive discharge module has been generated (PD), an "end of module" signal EOM and an "end of string" signal EOS are generated. As can be seen from FIG. 7, each function ends with an EOS signal, which causes the next function to be accessed from the string generator ROM 42. By using this technique, the basic functions may be executed in the minimum amount of time required.

In order to perform a 512 cell parallel addressing operation, a period of at least 71 microseconds is required for loading addressing data into the driver circuits. Therefore, if a write or erase fumction is to be performed, a string of modules will be assembled as shown in the remaining examples of FIG. 7. For a period of at least the 71 microseconds required to load the data, sustain functions composed of positive discharge (PD) and negative discharge (ND) modules will be assembled. After a time sufficient to load the data, a write (W) or erase (E) module is accessed. 512 cell parallel write strings are shown in FIG. 7 for both maximum and minimum brightness. For maximum brightness, there are 6 complete sustain functions followed by a write module (W) and a long sustain equilization module (LSE). During the time that the sustain functions are being executed, data is being loaded into the driver circuits. Then, near the end of the string, the 512 cell parallel write module (W) is accessed.

For a minimum brightness level string performing the 512 cell write operation, most of the negative discharge (ND) modules and positive discharge (PD) modules are removed, substituting blank sustain (BS), long sustain equilization (LSE), and short sustain equilization (SSE) modules. It can be seen that one complete sustain function will be performed before the write module (W) is accessed. In addition, the cycle shown for minimum brightness is extended to 120 microseconds, rather than the 100 microseconds of the maximum brightness string. Making the string longer with the same number of light emissions, of course, has the effect of further reducing the overall light emitted from the plasma display panel 70. The brightness control is discussed further below.

FIG. 7 also shows a 512 cell parallel erase string, for maximum brightness. There are 5 complete sustain functions, followed by a negative discharge module (ND), and the erase module (E). There are then two short sustain equilization modules (SSE), and a positive discharge module (PD) to end the string with a positive pulse. The requirement for this positive pulse was discussed above.

The total time for a write or erase operation is approximately 102 microseconds. In this time perid, 512 cells may be written. With non-module systems, 16 cells could be written in a period of 20 microseconds. Therefore, it may be seen that this system performs a write or erase function approximately 6.4 time faster than such systems. Even when the system is operating at the minimum brightness level shown in FIG. 7, and the write or erase function takes 120 microseconds to be performed, the system of the present invention is approximately 5.3 times faster than non-module systems. Therefore, the overall data rate of the system of the present invention is at least 5.3 times higher than the data rate of non-module systems.

Figure 10:
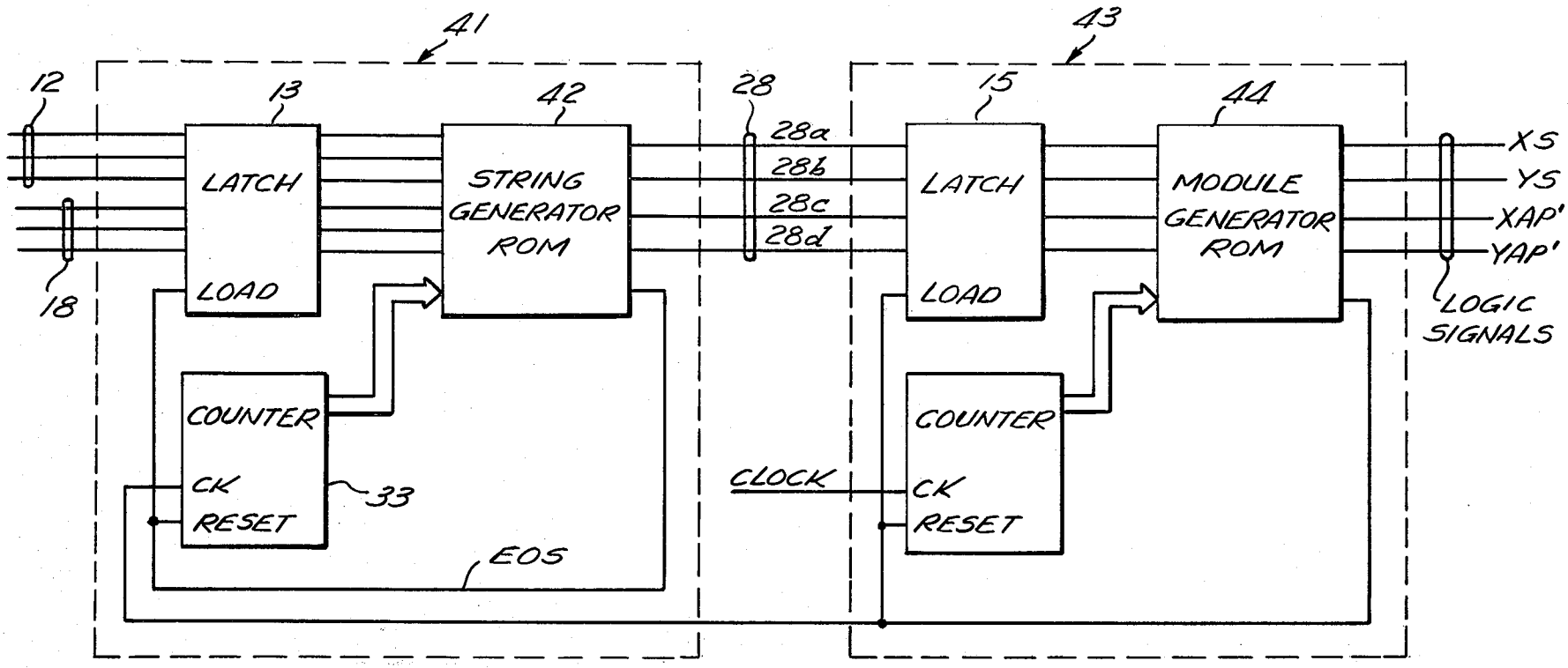
FIG. 10 is a block diagram schematic of the components of the present invention used to provide the logic signal outputs shown in FIGS. 4–6.

The actual circuitry used to form the modules and to assemble the strings of modules is shown in FIG. 10. There are two main components to the system: a string generator 41, and a module generator 43. The module generator 43 includes, as a component, the module generator ROM 44 shown in FIG. 8, and generates the individual modules described above. The string generator 41 includes, as a component, the string generator ROM 42, shown in FIG. 9, and assembles the modules in a desired string to perform whatever function is to be executed.

The operation of the module generator 43 is as follows. Module address information 28 (bits 28*a-d*) is supplied by the string generator 41, and defines which module is to be generated. This information is supplied via a latch 15 to the module generator ROM 44 when the previous module has been completed. The module generator ROM 44 will then output logic signals (XS, YS, XAP', YAP') which will cause the driver and sustainer circuitry to execute the desired module. The module generator ROM 44 is clocked through its addressable locations by timing information from a counter 35.

When a module has been completed, an end of module signal EOM will be output from the module generator ROM 44 as described above. This signal is supplied to the counter 35, causing it to reset. The EOM signal is also supplied to the latch 15, causing it to clock an address into the module generator ROM 44 defining the next module to be accessed in the string. Since the counter 35 has been reset, information from the next module will be accessed beginning at the first addressable location in that module.

These modules are assembled into strings by the string generator 41. When a module has been generated and the end of module signal EOM is supplied by the module generator ROM 44, the EOM signal is used as a clocking pulse for a counter 33. Each time the counter 33 receives this end of module signal EOM, it will increment and cause the string generator ROM 42 to output address information 28 defining the next module to be executed. If the address information 28 defines the last module in the string, an end of string signal EOS is generated by the string generator ROM 42. This end of string signal EOS causes the counter 33 to reset, and the latch 13 to provide to the string generator ROM 42 an address defining the next string which is to be performed. This address comprises the two inputs to the system: a brightness control input 12 and a mode control input 18.

As discussed above, by removing positive discharge modules and negative discharge modules from module strings, and inserting a number of blank sustain modules equal to the total number of positive discharge modules and negative discharge modules removed, the brightness level of the plasma display may be varied (FIG. 7).

Figure 11:
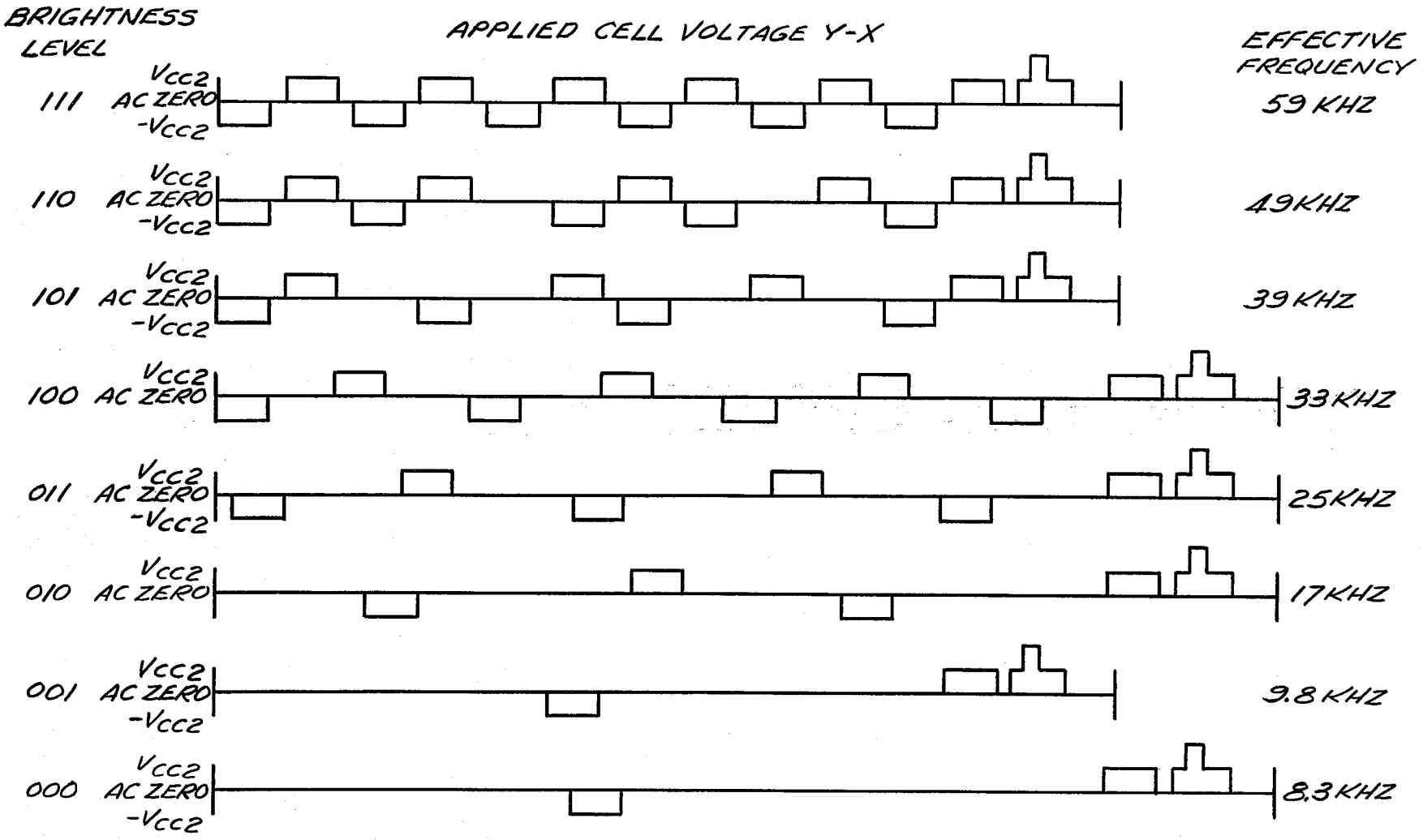
FIG. 11 shows the applied cell voltage Y–X for 512 cell parallel write functions having 8 different levels of brightness, the brightness level input causing each of these levels of brightness, and the effective frequency of each of the waveform strings.

FIG. 11 shows write strings for 8 brightness levels. Each of these strings produces a pulse of light at the leading edge of both the positive and negative discharge modules. As can be seen, the pulse trains vary from an effective sustain cycle frequency of 59 kHz down to an effective sustain cycle frequency of 8.3 kHz. This results in a variation in the frequency of emitted light pulse from 118 kHz to 16.6 kHz, or a brightness ratio of 7.1. In order to obtain a nearly linear reduction of brightness through the 8 levels, two cycle lengths are used: a 102 microsecond cycle length, and a 120 microsecond cycle length. It may be noted that the 59 kHz effective sustain cycle frequency provides a brightness level approximately 20% greater than that of the older 20 microsecond fixed period system.

Variation of brightness levels for an erase function would be similar to that of the write function, and the modules used to make a full brightness erase function have been described above.

Each function generated by a string of modules begins with a negative pulse and ends with a positive pulse. Therefore, having write functions and erase functions alternate, one after the other, will no longer cause the increase in brightness that characterizes older systems. In addition, since 512 cell parallel addressing is being utilized, the update rate of the system has increased by at least a factor of 5.3.

A large increase in the update rate of the system is not the only important advantage that can be obtained by using the 512 cell parallel addressing technique. A write function using this technique will execute one write operation in a 100-microsecond or greater period. It has been discovered that the border is only required to discharge once during the execution of the write function, as long as that discharge is timed so that it is executed immediately before the actual write operation occurs. The impact of this discovery is very significant, since it means that the brightness of the borders can be reduced by a factor of five for 100-microsecond write functions, and by a factor of six for 120-microsecond write functions. Even when the visual display area 75 is emitting light at its minimum brightness, the 8.3 kHz effective sustain cycle frequency, the average intensity of the light emitted from the border would be only slightly greater than the intensity of light emitted from the visual display area 75 of the plasma panel 70. Since the intensity of light emitted from the borders would remain constant at this minimum level, as the visual display area 75 emits more light, the light emitted from the sustainers is less and less important.

Figure 11A:
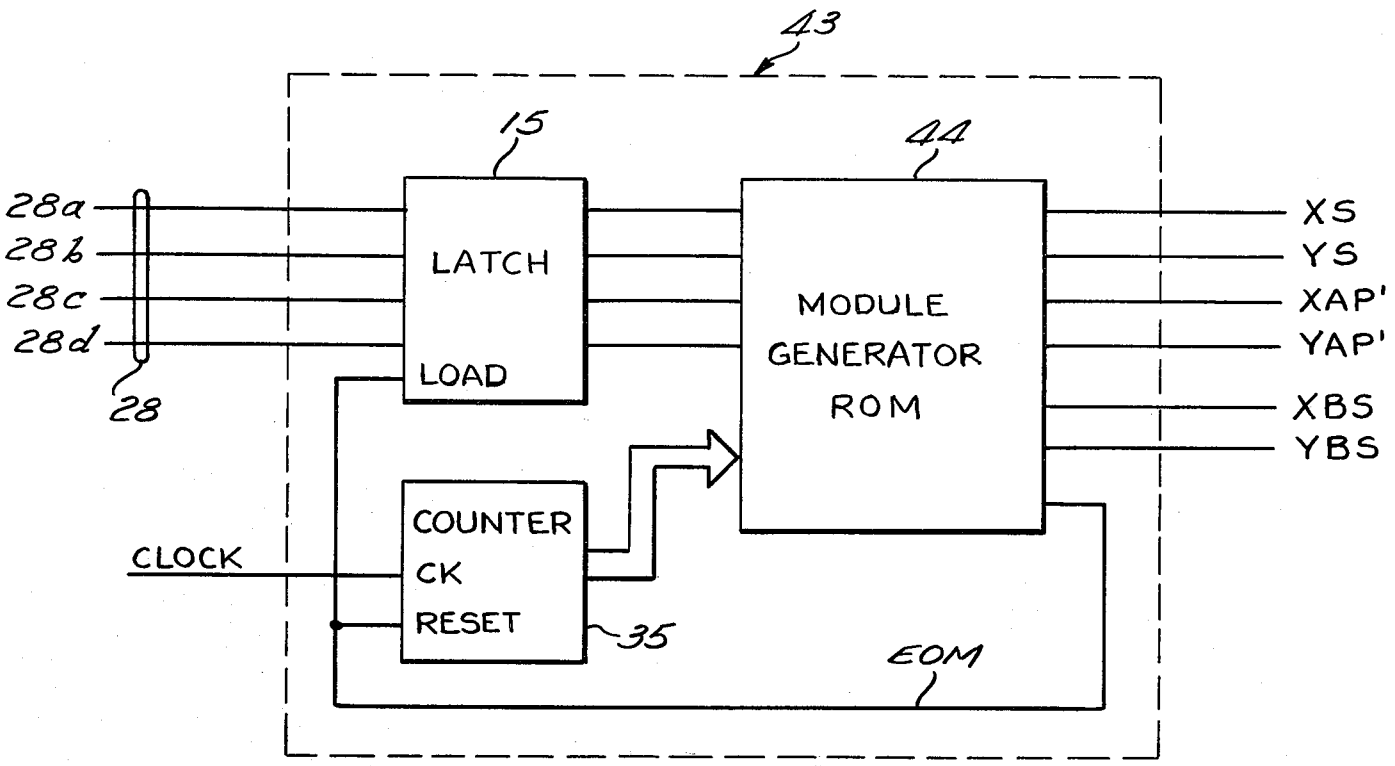
FIG. 11A is a block diagram of the module generator of FIG. 10 modified to produce XBS and YBS logic signals.

The modification to the system to operate the border sustainer is shown in FIG. 11A. Two additional logic signals, an X-Border Sustain signal XBS and a Y-Border Sustain signal YBS are produced, increasing the memory required in the module generator ROM 44 from 2.5K to 3.5K. Separate border sustainer logic, however, is no longer needed.

Figure 11B:
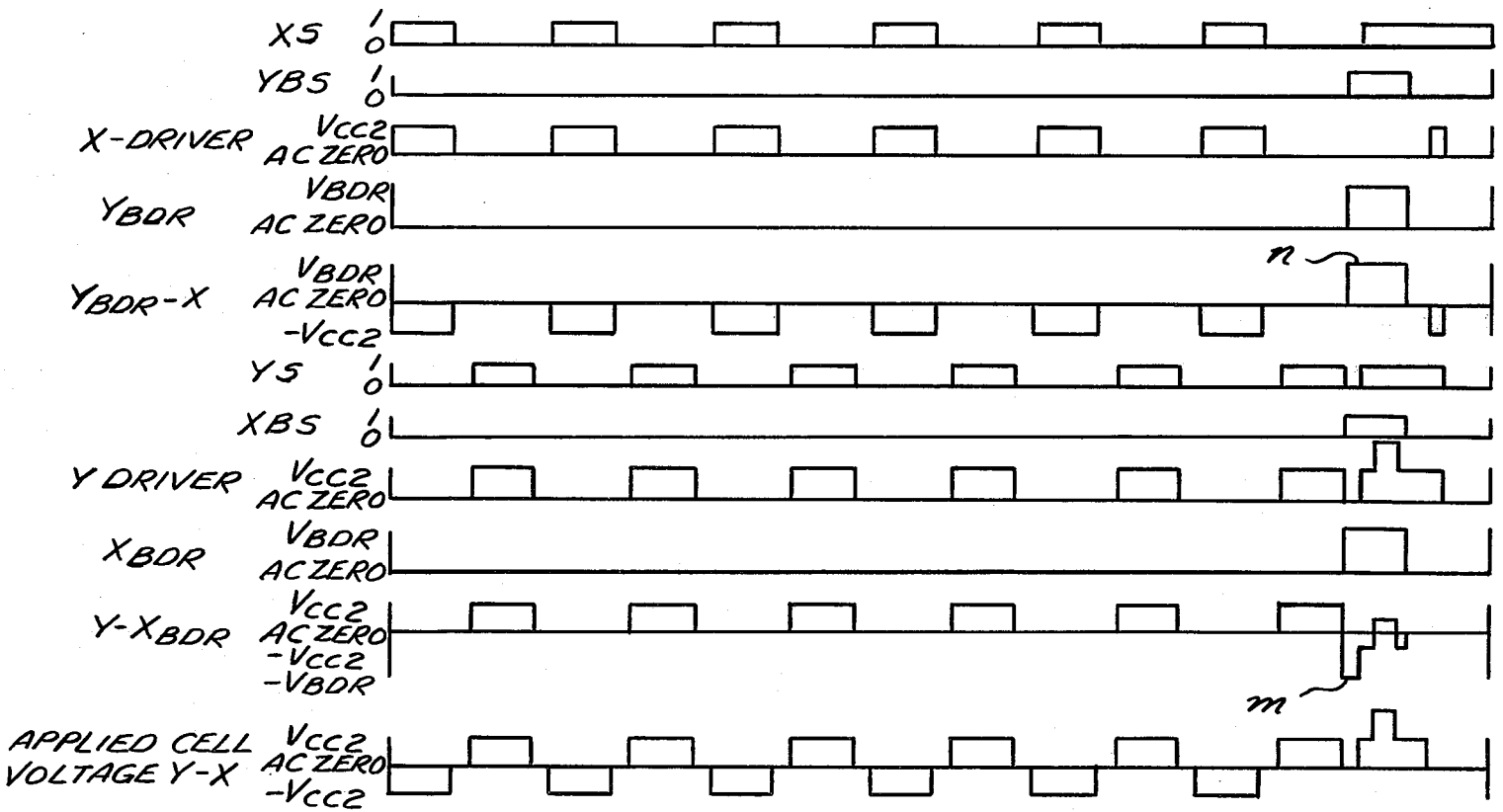
FIG. 11B shows the operation of the border sustainers in response to the logic signals generated by the apparatus of FIG. 11A.

FIG. 11B shows the applied X-border voltage $Y-X_{BDR}$ and the applied Y-border voltage $Y_{BDR}-X$ produced by the logic signals generated by the modular generator ROM 44 (FIG. 11A). These logic signals will cause the cells along the X-borders to discharge at the point indicated by m, and the cells along the Y-borders to discharge at the point indicated by n.

Although FIG. 11B shows the border discharges for a 512 cell parallel write function, similar border discharges will occur for the erase function and for sustain functions of lower frequency. Since sustain functions producing more light are comprised of shorter strings, only the three lowest light levels (effective sustain cycle frequency of 17 kHz, 9.8 kHz, and 8.3 kHz, analogous to the write cycles in FIG. 11), having 100 microsecond or longer strings, would produce border discharges. The reason border discharges are produced by erase and some sustain cycles is to prevent visible flashing of the borders at low brightness levels.

The speed at which the system is able to operate is very important. In the case of video data, where the display is being updated constantly, maximizing the update rate of the system is even more important. Since a video display is being updated constantly, each of the 512 lines of the display are being alternately erased and rewritten constantly. This means that it takes two 100-microsecond cycles to update a line—one cycle to erase the line and one cycle to write the line.

The present invention provides a technique whereby a horizontal line can be erased non-selectively, and then written selectively in one display cycle of 100 microseconds. By doing this, the display speed or update rate of the system is doubled.

The line erase module is shown in FIG. 12, preceded by a positive discharge module and followed by two short sustain equalization modules. The line erase module is non-selective; that is, it will perform an erase operation on an entire line, without requiring addressing data describing X-axis locations to be erased to be loaded.

By comparing the line erase module in FIG. 12 with the normal erase module in FIG. 5, it is apparent that the logic signals causing the function to be executed are different. Since the logic signals YS and YAP remain the same, the line erase module will selectively erase only along a single horizontal line. However, the X-electrodes are supplied with a signal generated solely by XS, and not by XAP, to perform the line erase operation. This means that the entire horizontal line will be erased, without using X-addressing data. For the normal erase operation, the XAP signal performs the erase function, so only electrodes designated by X-addressing data will be erased.

The advantage the line erase module has in not requiring the X-addressing data is that the 71 microsecond time required to load the X-addressing data into the driver chips is no longer a factor.

The function in which the line erase module is used is called the erase before write function, and is shown in FIG. 13. For the selected horizontal line, there are two types of cells—cells which will be "on" at the end of the erase before write function, and cells which will be "off" after the function. The cells to be left "on" are designated by the X-addressing data, so the write operation, which is selective, will be performed for these cells. The applied cell voltage for such cells is the lower waveform in FIG. 13.

The cells to be left "off" are not designated by the X-addressing data, so the write operation will not be performed for these cells. The applied cell voltage for such cells is the upper waveform of FIG. 13. It may be noted that the entire write pulse is not supplied to non-selected cells; they will therefore be "off" at the end of the erase before write function.

The write before erase function therefore takes the place of two functions—an erase function and a write function. The data rate of the system is thereby doubled, a result which is particularly beneficial if a video picture is to be displayed on the plasma display panel 70.

The present invention therefore solves the problem of lack of control of brightness in earlier systems when alternate brightness control write and brightness control erase modes were being utilized. Brightness can now be controlled with precision from the minimum brightness level to the maximum brightness level, regardless of what functions are being performed.

A greater range of brightness is also made possible, with the maximum brightness increased by approximately 20 percent over the maximum brightness of earlier systems. The high intensity of light emitted by the border electrodes has been eliminated as a problem, since the border electrodes are only discharged immediately before a write operation takes place. The intensity of light emitted by the border electrodes is only slightly brighter than that emitted by the visual display area 75 when the system is operating at minimum brightness, and dimmer than the visual display area 75 for all other brightness levels.

Since 512 cell parallel addressing is used, the data rate of the system is increased by a factor of at least 5.3. The utilization of an erase before write function allows the maximum data rate of the plasma display system to be further doubled, to 10.6. These increases in the data rate of the system enable continuous video displays, even those utilizing a television signal as an input.

What is claimed is:

1. A brightness control circuit for an AC plasma panel system, comprising:

means for generating a plurality of partial waveforms;

means for assembling groups of said partial waveforms sequentially to generate complex waveforms for driving a cell of said panel; and means for controlling said assembly means to select and combine partial waveforms into said complex waveforms to provide different levels of light emission.

2. A brightness control circuit for a plasma panel system, comprising:

means for generating a plurality of partial waveforms;

means for assembling groups of said partial waveforms to generate complex waveforms for driving said panel; and means for controlling said assembly means to select and combine partial waveforms into said complex waveforms to provide different levels of light emission;

wherein said partial waveforms include a positive discharge, a negative discharge, a write, an erase, and a blank sustain waveform.

3. A brightness control circuit as defined in claim 2, wherein said blank sustain waveform is characterized by the emission of substantially no light during its operation.

4. A brightness control circuit for an AC plasma panel with a multiplicity of cells, comprising:

means for generating partial waveforms;

means for generating complex waveforms for an AC plasma panel by sequentially assembling plural ones of said partial waveforms, said complex waveforms simultaneously addressing a group of said multiplicity of cells in parallel, said waveforms causing the emission of light from said multiplicity of cells; and means for varying said partial waveforms to provide different levels of light emitted from said multiplicity of cells.

5. A brightness control circuit as defined in claim 4, wherein said partial waveforms include a blank sustain waveform, said blank sustain waveform characterized by the emission of substantially no light during its operation.

6. A brightness control circuit for an AC plasma panel system, comprising:

first means for generating:

a first group of partial waveforms characterized by the emission of a first level of light from a cell of said panel;

a second group of partial waveforms characterized by the emission of a second level of light from said cell of said panel, said second level lower than said first;

second means for assembling, in a sequence, partial waveforms from said first group and said second group into complex waveforms;

third means for controlling the overall brightness of said panel, said third means causing said second means to decrease the number of waveforms from said first group, and to increase the number of waveforms from said second group applied to each cell of said panel.

7. A brightness control circuit for an AC plasma panel system, comprising:

first means for generating:

a first group of partial waveforms characterized by the emission of a first level of light from said panel;

a second group of partial waveforms characterized by the emission of a second level of light from said panel, said second level lower than said first;

second means for assembling partial waveforms from said first group and said sequentially complex waveforms;

third means for controlling brightness, said third means causing said second means to decrease the number of waveforms from said first group, and to increase the number of waveforms from said second group;

wherein: said first group of partial waveforms includes a positive discharge, a negative discharge, a write, and an erase waveform.

8. A brightness control for an AC plasma panel system, as defined in claim 7, wherein said second group of partial waveforms includes a blank sustain waveform.

9. A method of controlling brightness in an AC plasma panel system, comprising:

storing data defining a first group of waveforms that will cause light to be emitted from said panel;

storing data defining a second group of waveforms that will not cause light to be emitted from said panel;

supplying said panel with complex waveforms of at least one fixed length, said complex waveforms comprised of waveforms selected from said first and second groups; and varying brightness by reducing the number of waveforms from said first group in said complex waveform while simultaneously increasing the number of waveforms from said second group in said complex waveform.

10. A method of controlling brightness in an AC plasma panel system, as defined in claim 9, wherein said second group of waveforms includes waveforms of multiple lengths.

11. A method of controlling brightness in an AC plasma panel system, as defined in claim 9, wherein said first group of waveforms includes waveforms of multiple lengths.

12. A border electrode control for an AC plasma panel with border electrodes, comprising:

first means for generating partial waveforms;

second means for generating complex waveforms for said panel, said complex waveforms comprised of plural ones of said partial waveforms assembled sequentially;

third means for performing a sustain operation on said border electrodes; and fourth means for controlling said third means, and coupled to said second means, said fourth means causing not more than one sustain operation on said border electrodes to be executed during each of said complex waveforms.

13. A border electrode control for an AC plasma panel with border electrodes, comprising:

first means for generating complex waveforms for said panel, said complex waveforms comprised of partial waveforms;

second means for performing a sustain operation on said border electrodes; and third means for controlling said second means, and coupled to said first means, said third means causing not more than one sustain operation on said border electrodes to be executed during each of said complex waveforms;

wherein said partial waveforms include positive discharge, negative discharge, erase, and write waveforms.

14. A border electrode control for an AC plasma panel with border electrodes, as defined in claim 13, wherein said sustain operation on said border electrodes is performed immediately before said write waveform is executed.

15. A border electrode control for an AC plasma panel with border electrodes, as defined in claim 14, wherein said sustain operation on said border electrodes is only performed during selected ones of said complex waveforms.

16. A border electrode control for an AC plasma panel with border electrodes, comprising:

first means for sustaining said border electrodes;

second means for generating a complex waveform composed of partial waveforms, one of which is a write waveform; and third means for controlling said second means, said third means causing only a single border sustain operation to be executed immediately before said write waveform.

17. A method for generating a complex waveform for parallel addressing a line in an AC plasma panel having inherent memory wherein "on" cells emit light and "off" cells emit substantially no light, comprising:

a selective write pulse, said write pulse causing selected generating cells in said line to be turned "on"; and generating a non-selective line erase pulse, said line erase pulse causing all cells in said line being turned "off", said line erase pulse occurring before said write pulse in said complex waveform.

18. A method as defined in claim 17, wherein said line erase pulse precedes said write pulse by approximately half the period of said complex waveform.

19. A rapid update rate control system for an AC plasma panel, as defined in claim 19, wherein said complex waveform causes all cells in said line to be turned "off" before causing said selected cells in said line to be turned on.

20. A method of parallel addressing a line of cells in an AC plasma panel, comprising:

first performing a non-selective erase operation to erase all the cells in said line using a complex waveform; and second performing a selective write operation to write desired cells in said line using said complex waveform.

21. A method of parallel addressing, as defined in claim 20, additionally comprising:

supplying information to indicate which cells in said line are to be written during said second performing step simultaneously with said first performing step.

22. A method of parallel addressing, as defined in claim 20, wherein said non-selective erase operation and said selective write operation are performed in the amount of time required to perform said selective write operation only.

23. An AC plasma panel system comprising:

visual display area cells and border cells;

first means for generating light pulses in said visual display area cells to produce an image; and second means for generating light pulses in said border cells to provide free particles for said visual display area cells, said first means generating more light pulses than said second means when said first means is generating light pulses to produce an image.

24. A control circuit for an AC plasma panel, comprising:

first means for generating a write waveform in a fixed period;

second means for generating an erase waveform in a fixed period;

third means for alternatively, selectively supplying said write and erase waveform to each of plural selected cells of said panel;

fourth means for controlling brightness, said brightness control means reducing the brightness of said panel by at least 50% while said third means is alternatively supplying said write and erase waveforms to said selected cells of said panel.

25. A rapid update rate control system for an AC plasma panel with cells, comprising:

means for assembling data to parallel address a multiplicity of said cells in a first period;

means for performing a write operation in a second period after said data is assembled by said first means; and means for completely erasing and selectively writing in accordance with said data, said multiplicity of cells in a third period equal to the sum of said first and second periods.

26. A control circuit for an AC plasma panel, comprising:

first means for supplying a write waveform with a minimum effective period;

second means for supplying a sustain waveform with a minimum effective period, less than the period of said write waveform;

third means for continuously supplying multiple sustain waveforms generated by said second means to a selected cell of said panel, thereby causing said panel cell to emit light at a maximum brightness.

27. A border electrode control for an AC plasma panel with a border, comprising:

first means for sustaining said borders;

second means for generating a write function, said second means controlling said first means so that said border is sustained only before said write function is executed.

28. A method of providing a rapid update rate control for an AC plasma panel having lines of cells, wherein each of said cells has "on" and "off" charge states comprising:

generating a complex waveform, said waveform:

causing a first group of selected cells in a line to be turned "on"; and causing all cells in said line to be turned "off"; and repeating said step of generating a complex waveform causing a second group of selected cells in said line to be turned "on" and subsequently causing all cells in said line to be turned "off".

* * * * *

UNITED STATES PATENT AND TRADEMARK OFFICE

CERTIFICATE OF CORRECTION

PATENT NO. : 4,415,892

DATED : November 15, 1983

INVENTOR(S) : Michael J. Marentic

It is certified that error appears in the above-identified patent and that said Letters Patent are hereby corrected as shown below:

| Column | Line | |
|---|---|---|
| 1 | 22 | "pluse" should be --pulse-- |
| 3 | 14 | "June 2, 1981" should be --June 12, 1981-- |
| 3 | 46 | "50intensity" should be --50% intensity-- |
| 3 | 65 | "microsecond" should be --microseconds-- |
| 7 | 28 | "nodule" should be --module-- |
| 9 | 24 | "perid" should be --period-- |
| 13 | 62 | "and said sequentially" should be --and said second group sequentially into-- |
| 15 | 28 | "as defined in Claim 19" should be --as defined in Claim 28-- |

Signed and Sealed this

Seventeenth Day of April 1984

[SEAL]

*Attest:*

GERALD J. MOSSINGHOFF

*Attesting Officer*

*Commissioner of Patents and Trademarks*